US007820925B2

(12) United States Patent
Kuo et al.

(10) Patent No.: US 7,820,925 B2
(45) Date of Patent: Oct. 26, 2010

(54) MULTI-DIRECTIONAL SWITCH AND MULTI-DIRECTIONAL OPERATING DEVICE USING THE SAME

(75) Inventors: Peter Kuo, Tu-cheng (TW); Hao-Mai Yin, Kunshan (CN); Jiang-Hua Zhu, Kunshan (CN); Bing Du, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 820 days.

(21) Appl. No.: 11/784,833

(22) Filed: Apr. 10, 2007

(65) Prior Publication Data

US 2007/0235316 A1 Oct. 11, 2007

(30) Foreign Application Priority Data

Apr. 10, 2006 (CN) ..... 2006 2 0072333

(51) Int. Cl.
*H01H 25/04* (2006.01)

(52) U.S. Cl. ..... 200/6 A

(58) Field of Classification Search ..... 200/4, 200/5 R, 6 A, 17 R, 18, 329, 339; 341/20–22; 345/156–158, 160, 161, 168, 169
See application file for complete search history.

(56) References Cited

U.S. PATENT DOCUMENTS 5,804,781 A * 9/1998 Okabe ..... 200/6 A
5,949,325 A * 9/1999 Devolpi ..... 338/154
6,344,619 B1 * 2/2002 Yamasaki et al. ..... 200/6 A
6,423,911 B2 7/2002 Yoshida et al.
6,525,278 B2 * 2/2003 Villain et al. ..... 200/5 R
6,635,831 B2 * 10/2003 Kato ..... 200/4
6,750,408 B2 6/2004 Ueda
6,771,992 B1 * 8/2004 Tomura et al. ..... 455/575.1
6,791,037 B1 9/2004 Ling
6,794,589 B2 9/2004 Kubat et al.
6,875,934 B2 * 4/2005 Liu et al. ..... 200/6 A
6,974,920 B2 12/2005 Yu
7,253,367 B2 * 8/2007 Park et al. ..... 200/6 A
7,442,886 B2 * 10/2008 Hashida ..... 200/5 R
7,511,235 B2 * 3/2009 Osada ..... 200/6 A
7,518,070 B2 * 4/2009 Garcia-Briz ..... 200/6 A

* cited by examiner

*Primary Examiner*—Michael A Friedhofer
(74) *Attorney, Agent, or Firm*—Andrew C. Cheng; Wei Te Chung; Ming Chieh Chang

(57) ABSTRACT

A multi-directional switch includes a switch module, including a generally rectangular base, and an actuator vertically installed into a central receiving chamber defined in the base, the actuator can tilt away from a vertical axis to close one of four corners of the base, and a manual handle mated with the switch module, defining a central hollow being open toward the actuator for fittingly receiving the actuator therein, so as to permit synchronously swinging movement of the manual handle and the actuator. For preventing the manual handle, together with the actuator, synchronously swinging toward one of four corners, after the actuator is fittingly received in the central hollow of the manual handle, at least a rib is formed at a top surface of the base for abutting against a bottom surface of the manual handle, or formed at a bottom surface of the manual handle for abutting against a top surface of the base.

17 Claims, 6 Drawing Sheets

MULTI-DIRECTIONAL SWITCH AND MULTI-DIRECTIONAL OPERATING DEVICE USING THE SAME

BACKGROUND OF THE INVENTION

1. Field of the Invention

The present invention is directed to a switch, and more specifically, to a multi-directional switch.

2. Description of Related Arts

Multi-directional switches are widely used in cellular phones and personal digital assistants. One example is in a portable telephone with a screen that displays telephone numbers, and a multi-directional switch that allows the numbers to scroll up or down. When the desired name and telephone number are displayed, a person operates a validation switch to initiate a call. Further advances allow a user to select additional functions by incorporating additional switches that can be operated by a same actuator. Another example is in a remote control device with a multi-directional switch that controls a series of functions, such as stop, play, pause, and fast-forwarding, for operating a portable audio play remotely and conveniently.

The above types of switch arrangements with three or five switches can be implemented by an actuator that tilts about two horizontal axes to close one of four select switches, and that can be depressed to close a fifth validation switch. Examples are given in prior references, such as U.S. Pat. Nos. 6,974,920, 6,794,589 and 6,750,408. However, in a particular circumstance, several switches in a multi-directional switches are designed beforehand to abolish and have no use of achieving corresponding functions. If a user also can drive the actuator to tilt toward these disused switches, on one hand, it will produce redundant operation by a user; on the other hand, it may be regarded as a bug by a user, after an operation without acquiring corresponding functions.

Hence, a newly designed multi-directional switch is desired.

SUMMARY OF THE INVENTION

Accordingly, an object of the present invention is to provide a multi-directional switch for preventing abundant operation when several switches are designed to abolish.

Accordingly, another object of the present invention is to provide a multi-directional switch for allowing a user to operate exactly.

To achieve the above objects, a multi-directional switch includes a switch module including a generally rectangular base, and an actuator vertically installed into a central receiving chamber defined in the base, the actuator can tilt away from a vertical axis to close one of four corners of the base, and a manual handle mated with the switch module, defining a central hollow being open toward the actuator for fittingly receiving the actuator therein, so as to permit synchronously swinging movement of the manual handle and the actuator. For preventing the manual handle, together with the actuator, synchronously swinging toward one of four corners, after the actuator is fittingly received in the central hollow of the manual handle, at least a rib is formed at a top surface of the base for abutting against a bottom surface of the manual handle, or formed at a bottom surface of the manual handle for abutting against a top surface of the base.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 4:
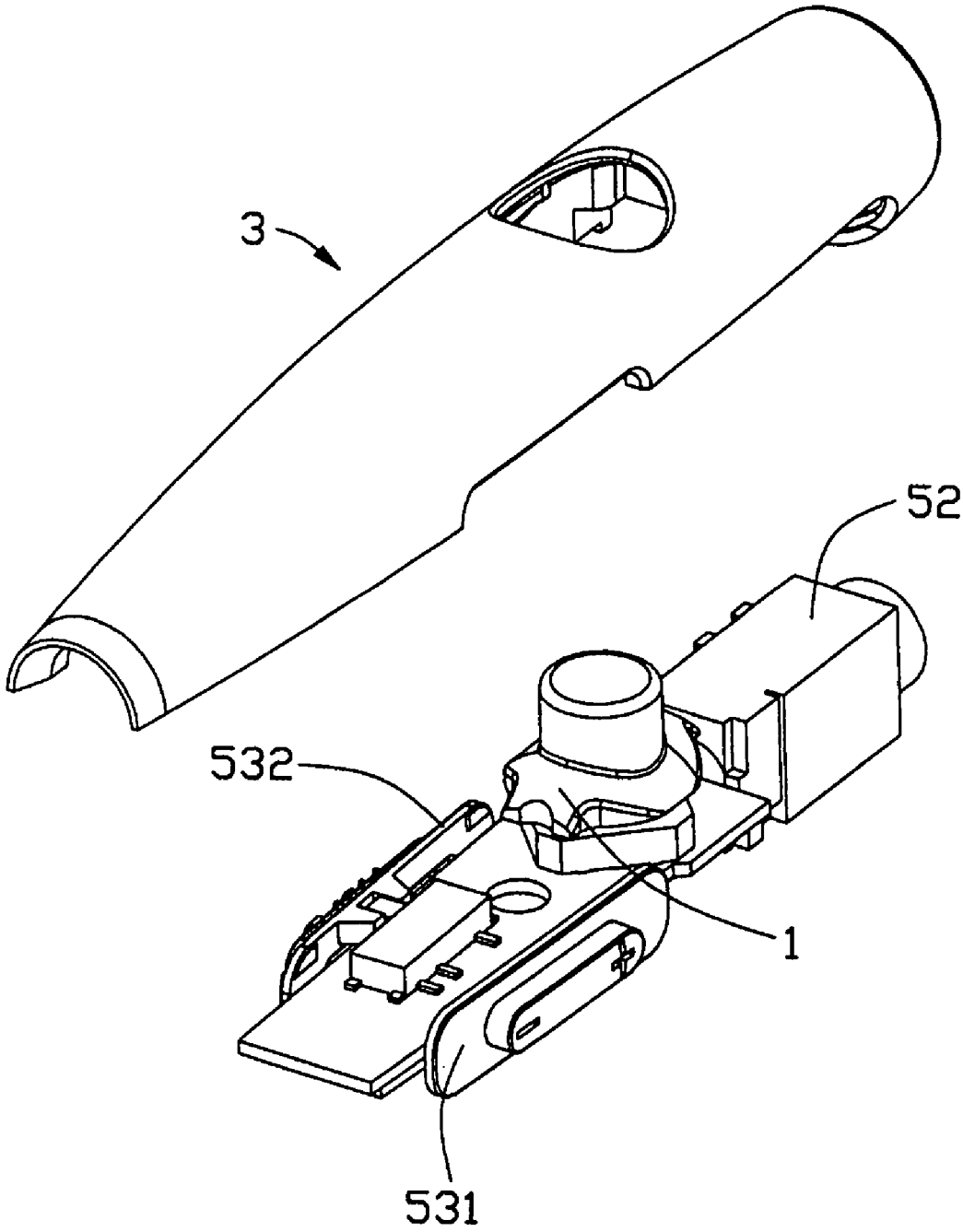
FIG. 4 is a partially assembled view of the remote control device.
Figure 5:
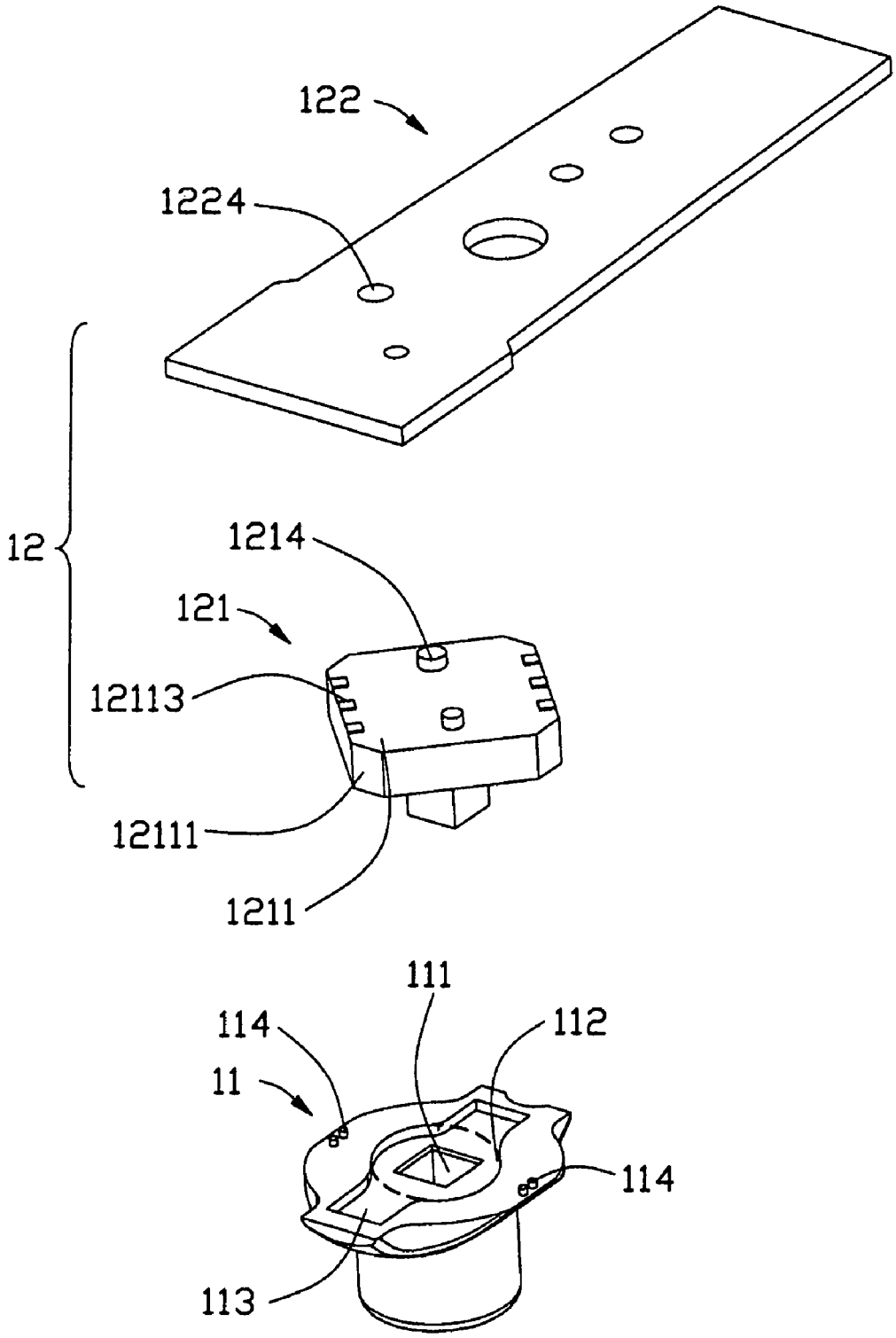
FIG. 5 is a perspective, exploded view of the multi-directional switch.
Figure 6:
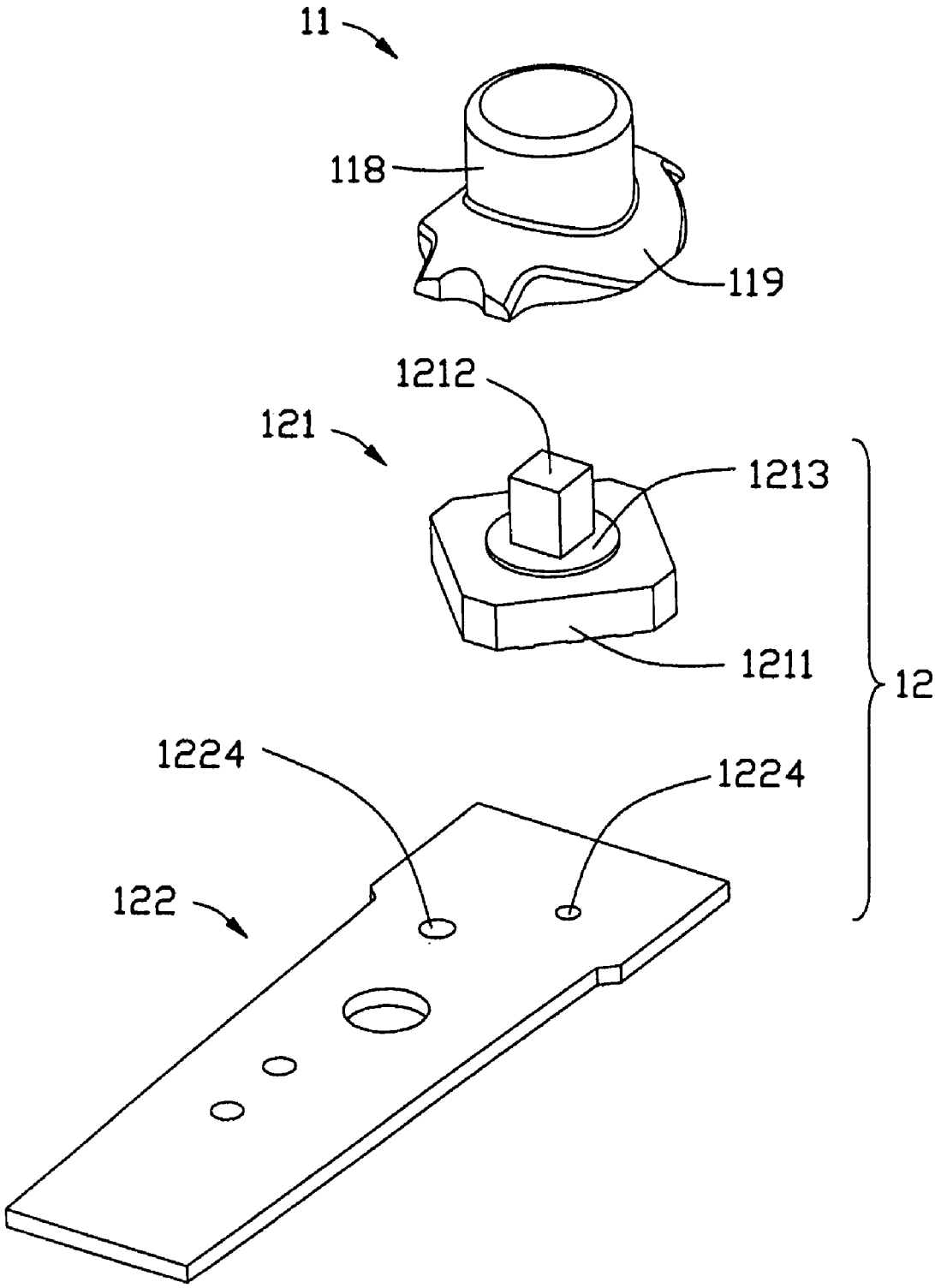
FIG. 6 is a view similar to FIG. 5, but taken from different aspect.

With respect to FIGS. 4-6, a preferred embodiment of a multi-directional switch 1 in according with present invention is shown to include a main portion 12, and a manual handle 11, through which a user can achieve a multi-directional operation. The main portion 12 includes a printed circuit board 122 with a plurality of electrical pads and traces (not shown) formed thereon that can transmit switch signals and handle input signals to control corresponding functions of a portable audio player (not shown), and a switch module 121 installed onto and electrically connected with the printed circuit board 122.

Referring to FIG. 5-6, the switch module 121 includes a base 1211 with a generally square cross-sectional view. The base 1211 defines a bottom wall (not labeled) with a pair of positing columns 1214 that are installed into corresponding through holes 1224 of the printed circuit board 122 for holding the switch module 121 in position. In another preferred embodiment, four corners of the base 1211 are vertically cut and form four angled inclining portions 12111.

The switch module 121 also includes a receiving chamber (not labeled) defined at a center position thereof for receiving an actuator 1212. As similarly illustrated in prior references, such as U.S. Pat. No. 6,974,920, the switch module 121 also comprises four dome-shaped conductive plates disposed around a central plate (shown in FIG. 3 or FIG. 6 of U.S. Pat. No. 6,974,920). These five plates are respectively electrically connected to corresponding contacts 12113 disposed at the bottom wall when the actuator 1212 tilts close to one of four selected plates or is depressed to close the central plate, and can send a selected function command to the printed circuit board 122 due to an electrical jointing between the contacts 12113 and the traces formed on the printed circuit board 122.

However, in another preferred embodiment, the switch module 121 is only designed to achieve several functions, and includes a pair of conductive plates and a central plate that are electrically connected to the contacts 12113. For example, along one horizontal axis, the actuator 1212 can be tilted to close two existing conductive plates, or depressed to press the central plate, for providing an electrical connection. Along another horizontal axis, in this embodiment, which is perpendicular to said horizontal axis, the actuator 1212 can be tilted, however, for reason of absence of two conductive plates, cannot achieve an electrical connection. In other words, even through the actuator 1212 is driven toward these two direction, these are no corresponding functions reflected by the portable audio player. In addition, as similarly illustrated in FIG. 2 of prior reference, U.S. Pat. No. 6,344,618, a metal shell with a hollow open formed thereon, through which the actuator 1212 extends, is provided for shielding the base 1211 and soldering with the printed circuit board 122, thereby consequently holding the switch module 121 in position, and preventing EMI (Electro-Magnetic Interference).

Referring to FIG. 6, the switch module 121 further includes an annular key seat 1213 with a rectangular central hole (not labeled) formed through, and the actuator 1212 that has a rectangular cross-sectioned upper portion (not labeled) which extends through and which is received fittingly within the central hole in the key seat 1213 so as to permit synchronous swinging movement of the key seat 1213 and the actuator 121. The shape of key seat 1213 and associated operation are similarly to that illustrated in U.S. Pat. No. 6,794,920, and their detailed descriptions are omitted thereafter. Noticeably, said five conductive plates is of fornical shape and can return the actuator 1212 to a normal position.

Referring to FIG. 5, the manual handle 11 with a generally T-shape cross-sectional view, includes a truncated conical portion 119, and a columned operation portion 118 upwardly extending from top of truncated conical portion 119. The actuator 1212 is received fittingly within a hollow 111 defined in the columned operation portion 118, and being open toward a top surface of the base 1211 so as to permit synchronous swinging movement of the actuator 1212 and the manual handle 11. The truncated conical portion 119 defines a depressed portion (not labeled), which is consisted of a rounded receiving space 112 (broken line illustrated in FIG. 5), and a pair of lateral receiving space 113 defined at two sides of the rounded receiving space 112 in a lengthwise direction thereof. The rounded receiving space 112, together with the hollow 111, has a same vertical axis. In addition, from a bottom wall (not labeled) of the truncated conical portion 119, a plurality of ribs 114 that are directed to a reverse direction relative to the manual handle 114 and disposed at two lateral sides of rounded receiving space 112.

The manual handle 11 is assembled to the switch module 121, with a upper portion of the key seat 1213 being fittingly received in the rounded receiving space 112. During operation by a user, the manual handle 12, together with the actuator 1212, may be synchronously tilted forwardly or rearwardly along the lengthwise direction, and achieve corresponding functions, or may be synchronously pressed downwardly for achieving another function. And, the lateral receiving space 113 receives the angled inclining portions 12111 and provides enough deflective angle for the manual handle 11 and the actuator 1212. However, when the manual handle 12 is tilted toward lateral direction for a mistake operation by users, the ribs 114 will abut against a top surface of metal shell, presumed that a metal shell is provided, or abut against the top surface of the base 1211, for limiting tilts of the manual handle 11 and actuator 1212.

In another preferred embodiment, the ribs 114 are formed on the top surface of the base 1211 and at two remote ends of a diagonal of the base 1211. This design also can prevent abundant operation for anticipative abuttal between the ribs 114 and the bottom wall of the truncated conical portion 119. Obviously, if the metal shell is provided, a corresponding through hole (not shown), through which the ribs 114 extends, must be provided accordingly. And, it is noted that other shapes structures can replace the ribs 114 formed either at the manual handle 11 or at the switch module 121, such as conic protruding, inclining protruding. By these alternative structures, the needless directional operation also can be bared.

Referring to FIGS. 1-6, in a preferred embodiment, the multi-directional switch is applied in a remote control device 100. The remote control device 100 comprises a first cover half 2 with a structure shaped like a boat, a second cover half 3 attached to the first cover piece 2 and defining a receiving space 4 together with the first cover half 2, the multi-directional switch 1 with a printed circuit board 51 received in the receiving space 4 and with a plurality of components (Detailed depiction shown hereinafter) located thereon, a cable 70 electrically connected to the printed circuit board 51 and with a stress relief 71 disposed at a front portion thereof, and a clip 6 pivotally attached to the first cover half 2 for clipping the remote control device 100 to a user's clothing or handbag or on some other convenient objects.

With respect to FIGS. 1-4, the first and second cover halves 2, 3 are formed of an insulated material with enough rigid, and assembled to each other. The first cover half 2 defines a first pair of positing columns 25 in a front-to-rear direction, which are hollow and open toward exterior. The second cover half 3 defines a pair of second positing columns 35 in alignment with the first columns 25. A pair of screws 401, 402 extends through first positing columns 25, with tips thereof being rotated into the second positing columns 35 for holding two cover halves 2, 3 together.

With respect to FIGS. 1-4, the first cover half 2 defines a hollow portion 20, and with a pair of through holes 201 formed at lateral sides thereof and being communicated with the hollow portion 20. And, the clip 6 comprises a longitudinal base (not labeled), and a pair of fixing pieces 61 upwardly extending from one end of the base. Each fixing piece 61 defines a hole 611 therein, which aligns with the through hole 201 and a central hole (not labeled) of a spring 8. A pole 9 extends through the holes 611, 201 and the hole of the spring 8 for attaching the clip 6 to the first cover half 2 and allowing the clip 6 to pivot upon the pole 9.

Figure 1:
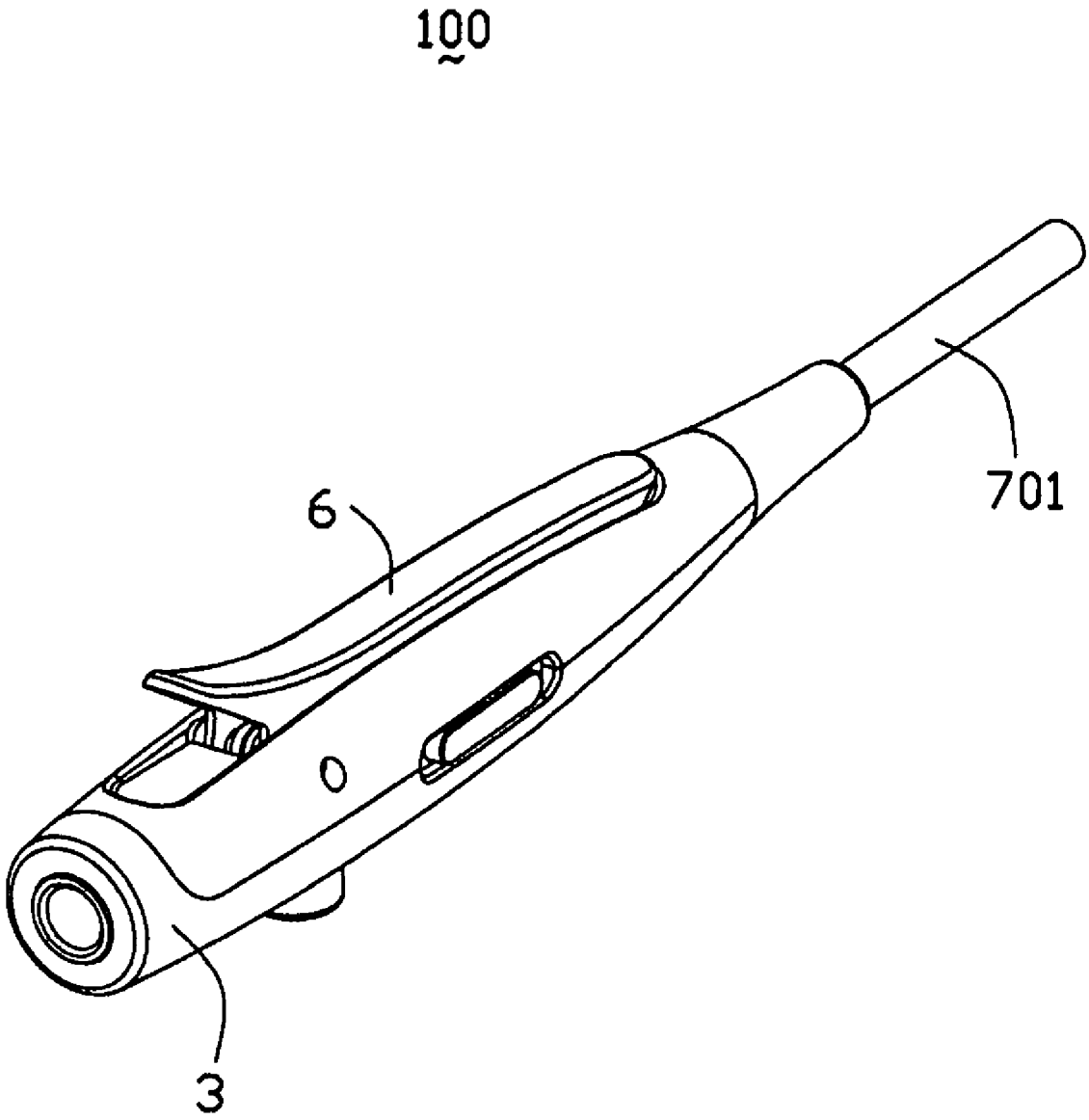
FIG. 1 is a perspective, assembled view, wherein a multi-directional switch in accordance with the present invention is installed in a remote control device.
Figure 2:
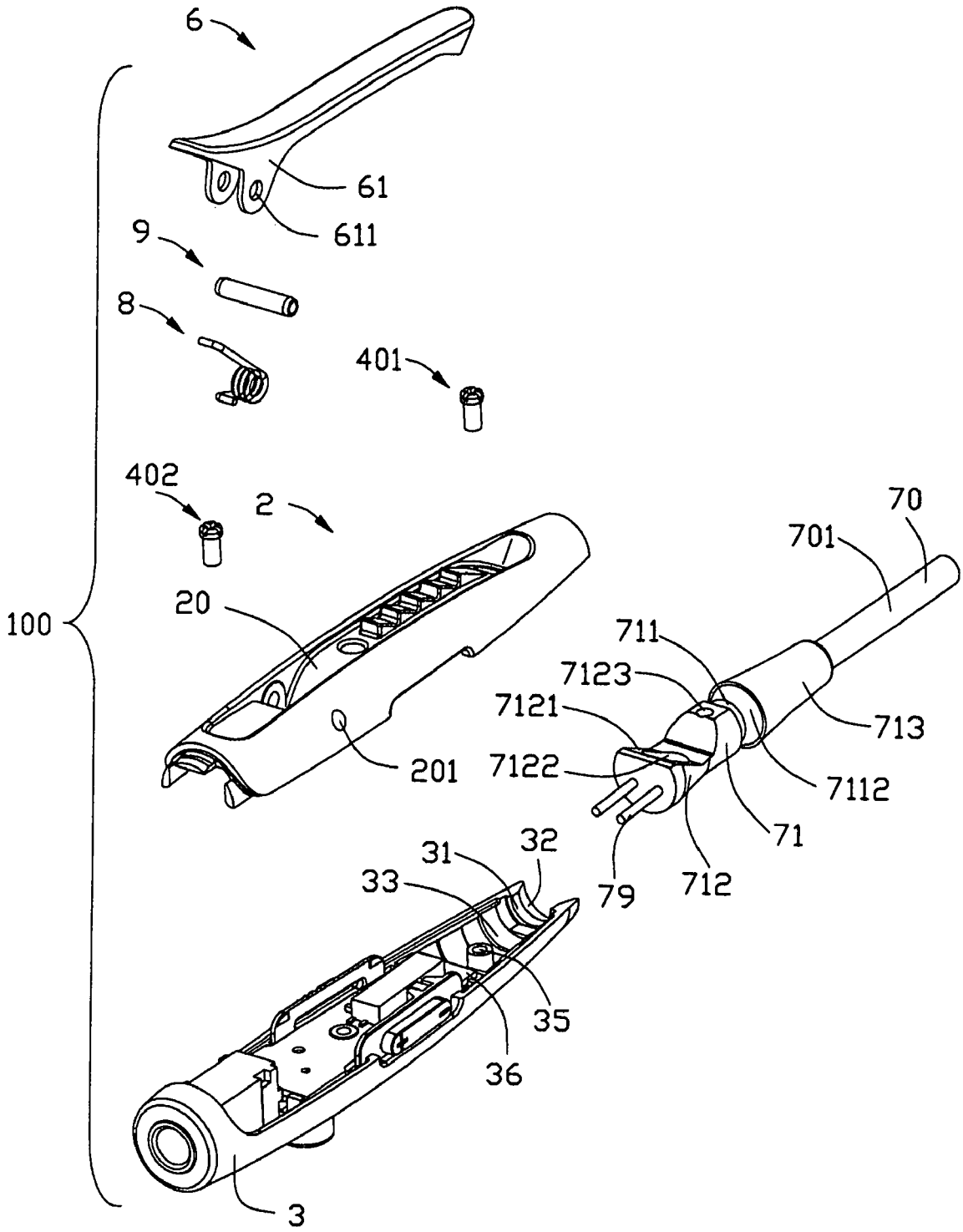
FIG. 2 is a perspective, exploded view of the remote control device with the multi-directional switch.
Figure 3:
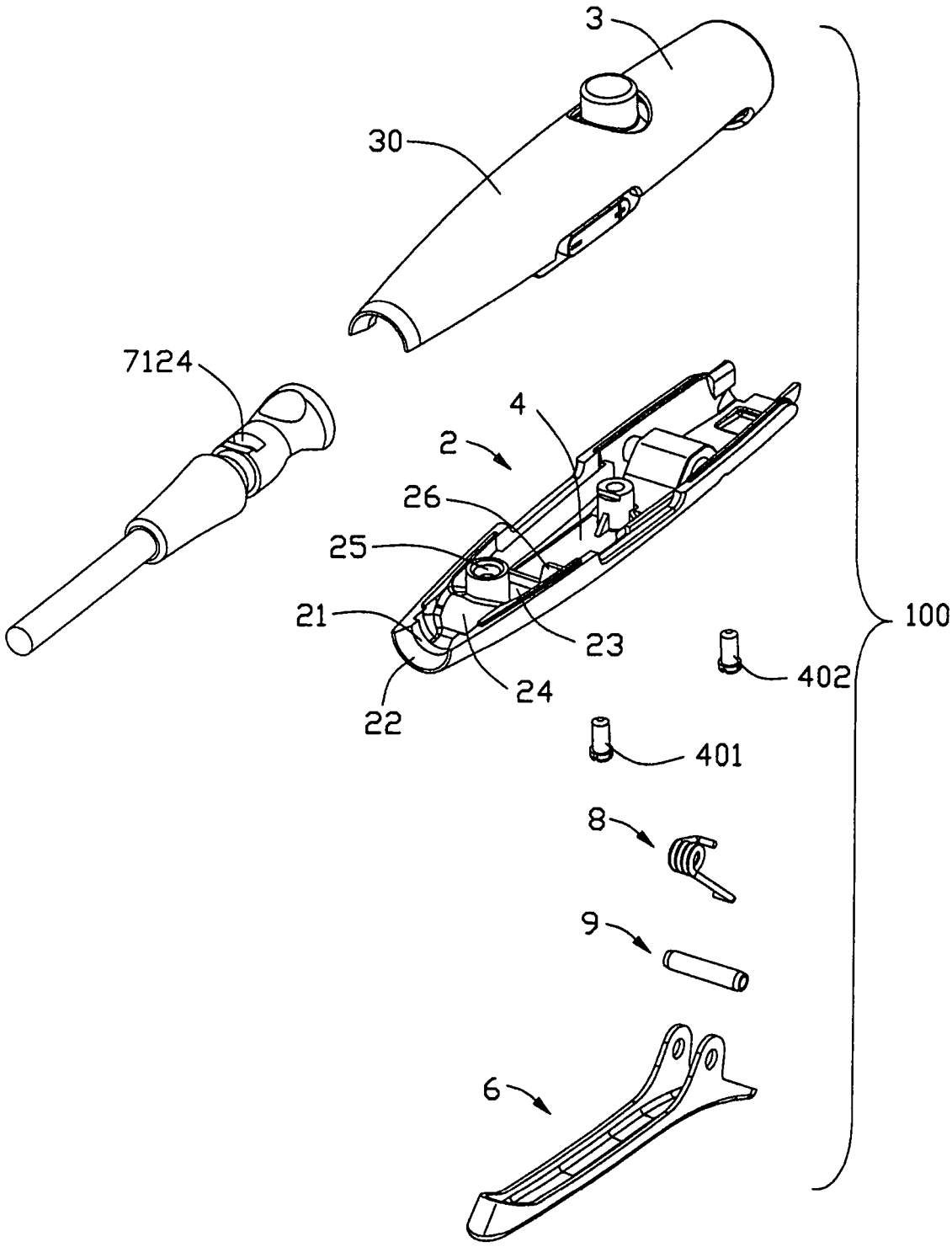
FIG. 3 is a view similar to FIG. 2, but taken from a different aspect.

With respect to FIGS. 2-3, in two generally semi-circular spaces 23, 33 of the first and second cover halves 2, 3, there respectively forms a traverse rib 26, 36 so as to abut against a front surface of the stress relief 71 and prevent a forward trend thereof.

The flexible cable 70 includes a plurality twisting wires or parallel wires 79 for transmitting data signals, such as power signal or audio signal, and an insulative jacket 701 surrounding the wires 79, with front parts of wires 79 being exposed beyond the insulative jacket 701. Each wire 79 includes at leas a conductor (not shown) for electrically terminated to the printed circuit board 51, and achieving an electrical connection therebetween. The stress relief 71 is integrally molded with a front part of the cable 70. Referring to FIG. 2, the stress relief 71 includes a columned head 712, with a V-shape inclining cut 7121 formed thereon. This columned head 712, shaped decreasingly in diameter along a lengthwise direction, defines a though hole 7122 extending through the incline cut 7121 and aligned with the positing column 35. Said screw 101 extends through the first column 25, the through hole 7122 successively, and into the second positing column 35 for reliably holding the stress relief 71 with the cable 70 within the cover halves 2, 3. In addition, the semi-circular space 23, 33 cooperate together to receive the columned head 712, and the V-shape inclining cut 7121 is suitable to mate with a generally inclining protruding 24, for providing a reliable assembly and preventing a rotation along a lengthwise axis.

The stress relief 71 also includes an annular slot 711, and a rod 713 behind the annular slot 711. The annular slot 711 is lower than the rod 713 and the columned head 712, and shaped as a neck-like configuration. Reversely, each cover half 2, 3 forms a semi-circle rib 21, 31 extending inwardly from inner surfaces thereof, and sequentially, the cover halves 2, 3 form a circumferential rib when these two cover halves 2, 3 engage with each other. The circumferential rib surrounds and interferentially engages with the annular slot 711. By above cooperation, the stress relief 71 is reliably hold in position and can hardly remove forwardly or rearwardly relative to the cover halves 2, 3. Behind the semi-circle rib 21, 31, each cover half 2, 3 form a smooth receiving room 22, 32, with a diameter being increased along a front-to-rear direction after engagement of two cover halves 2, 3. Therefore, these two receiving room 22, 32 together defines a general conic room. Corresponding, a front portion of the rod 713 is shaped smoothly to form an ascending wall 7112, this wall 7112 forms an ascending grade structure for fitly engaging with the general conic room.

According to above description, the columned head 712 is fitly and closely received in rounded receiving space 23, 23, the V-shape inclining cut 7121 is fitly engaged with the inclining protruding 24, for preventing a distortion upon the cable 70 and stress relief 71. Further, an engagement of the annular slot 711 and the ribs 21, 31, can hold the stress relief 71 in position. An engagement of the ascending wall 7112 fitly and closely is received in the conic room for decreasing distortion when a twisting occurs upon the cable 70. In brief, due to the design of stress relief 71, the cable 70 and the stress relief 71 and joint between the cable 70 and the printed circuit board 51 can hardly suffer from distortion even if a twisting happens to cable 70.

With respect to FIGS. 1-6, the components simply described above, includes a plug 52 located at a front portion of the cable assembly 100, a first sliding switch 531 installed on the printed circuit board 51, which can control a volume, a second sliding switch 532, which can lock other key-presses or switches from an improper operation, and the multi-directional switch 1 described as above.

During a process to mold the stress relief 71 over the cable 70 conveniently, a pair of poles (not shown) is adopted to hold the cable 70 in position. Then after subsequent processes of cooling the melted plastic material and taking way the mold, a pair of apertures 7123, 7124 are formed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A multi-directional switch, comprising:

a switch module, including a generally rectangular base, and an actuator vertically installed into a central receiving chamber defined in the base, the base including four conductive plates and a central conductive plate surrounded by the four conductive plate, wherein the actuator can tilt about two horizontal axes to close one of four conductive plates, and also can be depressed to close the central conductive plate;

a metal shell shielding the switch module, with a central through hole, through which the actuator extends;

a manual handle mated with the switch module, and including a truncated conical portion, and an operation portion upwardly extending from a surface of the truncated conical portion, wherein the truncated conical portion is of a generally round shape from a bottom view thereof, with at least one protrusion laterally extending away from a central axis of the truncated conical portion, wherein the manual handle defining a central hollow extending through the truncated conical portion for fittingly receiving the actuator therein, so as to permit synchronously swinging movement of the manual handle and the actuator;

wherein, for preventing the actuator, together with the manual handle, synchronously swinging toward one of four conductive plates, at least a rib is formed at a corresponding position of a bottom wall of the truncated conical portion to abut against a top surface of the metal shell.

2. The multi-directional switch as described in claim 1, wherein the four conductive plates is respectively disposed at four corners of the base, and at least a rib is formed at corresponding corner of the bottom wall of the truncated conical portion, when at least one of four conductive plates is requested not to achieve an electrical connection.

3. The multi-directional switch as described in claim 1, wherein the switch module includes a key seat installed in the central receiving chamber and with a central through hole for allowing the actuator to extend through, and this key seat includes four flanges respectively touching said four conductive plates.

4. The multi-directional switch as described in claim 3, wherein the said conductive plates are similarly of a fornical shape, for providing a restorative force to drive the actuator to a normal position.

5. The multi-directional switch as described in claim 3, wherein the truncated conical portion includes a depressed rounded receiving space communicated with the central hollow, for receiving a portion of the key seat, this portion extends beyond a distance relative to a top surface of the base.

6. The multi-directional switch as described in claim 5, wherein the truncated conical portion includes at least a receiving space at a lateral side of the rounded receiving space along the at least one protruding, for receiving a corresponding tip of the base and providing enough operation room when the actuator is tilted to one of four conductive plates.

7. The multi-directional switch as described in claim 1, wherein the operation portion is of a columnar shape, and the central hollow is defined therein with a rectangular cross-sectional view, for fittingly receiving the actuator, which also has a rectangular cross-sectional view.

8. The multi-directional switch as described in claim 1, wherein further comprising a printed circuit board, with at least a through hole, for supporting and engaging with the switch module by an fitting mating between at least a post disposed at the switch module and the through hole of the printed circuit board.

9. A multi-directional switch, comprising:

a switch module, including a generally rectangular base, and an actuator vertically installed into a central receiving chamber defined in the base, wherein the actuator can tilt away from a vertical axis to close one of four corners of the base; and a manual handle mated with the switch module, defining a central hollow being open toward the actuator for fittingly receiving the actuator therein, so as to permit synchronously swinging movement of the manual handle and the actuator; wherein for preventing the manual handle, together with the actuator, synchronously swinging toward one of four corners, after the actuator is fittingly received in the central hollow of the manual handle, at least a rib is formed at a top surface of the base for abutting against a bottom surface of the manual handle, or formed at a bottom surface of the manual handle for abutting against a top surface of the base;

wherein the actuator is of a rectangular cross-sectional configuration, and two of four sidelines thereof are parallel to a diagonal of the base, and the other two of four sidelines thereof are parallel to the other diagonal of the base.

10. The multi-directional switch as described in claim 9, wherein the base includes four conductive plates, and a central conductive plate received in inner thereof and aligned with four corners of the base along a vertical direction.

11. The multi-directional switch as described in claim 10, wherein the switch module includes a key seat installed in the central receiving chamber and with a central through hole for allowing the actuator to extend through, this key seat includes four flanges respectively touching one of four conductive plates when the actuator tilts toward this corner of the base.

12. The multi-directional switch as described in claim 9, wherein the manual handle includes a truncated conical portion, and an operation portion upwardly extending from a surface of the truncated conical portion and with a column-shape configuration.

13. The multi-directional switch as described in claim 12, wherein the truncated conical portion is of a generally round shape from a bottom view thereof, with a pair of protruding laterally extending away from a central axis of the truncated conical portion.

14. The multi-directional switch as described in claim 13, wherein pluralities of ribs are respectively formed at a line, which line is perpendicular to that line defined by linking two protruding.

15. A multi-directional switch comprising:

a printed circuit board;

a switch module defining a base with a plurality of contact pads mounted upon the printed circuit board, said base defining a generally square configuration with a first diagonal line along a front-to-back direction and a second diagonal line along a lateral direction perpendicular to said front-to-back direction, an actuator formed at a center of the base and designed to be downwardly depressed or tilted toward two of said four corners of the base only in the front-to-back direction; and a handle including an upper columnar operation portion surrounding the actuator and a lower truncated conical portion outwardly spanned along a circumstantial lower region of the columnar operation portion; wherein the handle defines a receiving space in an undersurface thereof along the front-to-back direction to slightly receive a corresponding portion of said base along said first diagonal line for easing tilting of the actuator in said front-to-back direction.

16. The multi-directional switch as claimed in claim 15, wherein in an interface between the base and the handle, a pair of protrusions are located on two lateral sides thereof to abut against the corresponding corners in said second diagonal line for preventing tilting of the actuator in said lateral direction.

17. The multi-directional switch as claimed in claim 16, wherein said pair of protrusions are formed on said undersurface.

* * * * *